US007422463B2

(12) United States Patent
Kuo

(10) Patent No.: US 7,422,463 B2
(45) Date of Patent: Sep. 9, 2008

(54) FAST COUPLING STRUCTURE OF WATERPROOF CABLE CONNECTOR

(76) Inventor: Ko-An Kuo, No. 78, Lane 128, Sanmin Rd., Luzhou City (TW) 247

( * ) Notice: Subject to any disclaimer, the term of this patent is extended or adjusted under 35 U.S.C. 154(b) by 0 days.

(21) Appl. No.: 11/898,727

(22) Filed: Sep. 14, 2007

(65) Prior Publication Data

US 2008/0194137 A1 Aug. 14, 2008

(30) Foreign Application Priority Data

Feb. 9, 2007 (TW) ..... 96202508 U

(51) Int. Cl.
*H01R 13/627* (2006.01)

(52) U.S. Cl. ..... 439/349; 439/589; 439/277

(58) Field of Classification Search ..... 439/349, 439/589, 271, 277

See application file for complete search history.

(56) References Cited

U.S. PATENT DOCUMENTS

| | | | | |
|---|---|---|---|---|
| 5,362,258 | A * | 11/1994 | Arnswald et al. | 439/695 |
| 5,480,315 | A * | 1/1996 | Martinelli | 439/271 |
| 5,785,544 | A * | 7/1998 | Linden et al. | 439/278 |
| 7,175,459 | B2 * | 2/2007 | Milner et al. | 439/271 |
| 7,195,505 | B1 * | 3/2007 | Becker | 439/282 |
| 7,207,820 | B1 * | 4/2007 | Montena | 439/275 |

* cited by examiner

*Primary Examiner*—Ross N Gushi
(74) *Attorney, Agent, or Firm*—Birch, Stewart, Kolasch & Birch, LLP

(57) ABSTRACT

The invention relates to a fast coupling structure of waterproof cable connector, mainly comprising a male connecting joint and a female connecting joint, both are positioned on the cable end for connection of electric power source or signals on an electric apparatus; the invention enables both of the male and the female connecting joints to have the fast coupling function and the waterproof effects; therefore, a user is able to easily and quickly connect or disassemble the coupling structure.

2 Claims, 5 Drawing Sheets

FAST COUPLING STRUCTURE OF WATERPROOF CABLE CONNECTOR

BACKGROUND OF THE INVENTION

I. Field of the Invention

The present invention relates to a fast coupling structure of waterproof cable connector, especially to a cable connector structure for connection of electric power source or signals on an electric apparatus. The invention comprises a male connecting joint and a female connecting joint, both having the waterproof and fast connection effects; therefore, a user is able to easily and quickly connect or disassemble the coupling structure.

II. Description of the Prior Art

Generally, a conventional cable connector structure for connection of electric power source or signals on an electric apparatus (as shown in FIGS. 4 and 5) mainly comprises a male connecting joint 40 and a female connecting joint 50 by molding, both are fastened on the electric power source or signal transmission end of a cable wire 30. The characteristics are described as follow.

The male connecting joint 40 comprises a male housing 41, a connecting nut 42 and a plurality of male connectors 43. The male connectors 43 are inserted in the male housing 41 and connected with an electric conductive copper-core of the cable wire 30. The connecting nut 42 is used to cover the male housing 41 from the rear thereof, positioned between the male housing 41 and a molding wiring gripper 32 and is able to revolve freely. The female connecting joint 50 comprises a female housing 51, a metal tube 52 and a plurality of female connectors 53. The female connectors 53 are mounted in the female housing 51 and connected with an electric conductive copper-core of the cable wire 30; the metal tube 52 is positioned on the outer surface of the female housing 51, having outer threads 521 on the front thereof to screw the connecting nut 42 together.

Said conventional structure enables the male connecting joint 40 and the female connecting joint 50 to be screwed together through the connecting nut 42 of the male connecting joint 40 and the metal tube 52 of the female connecting joint 50. To avoid the detachment of the male connecting joint 40 and the female connecting joint 50 and to enable the waterproof effect, the conventional structure has two anti-seepage rings 44 (disposed inside the connecting nut and outside the male housing, as shown in FIG. 5) on the male housing 41 and the rim of the female housing 51 tightly connected. The drawbacks of said conventional structure lies in that a user has to screw the components first; however, said connecting nut 42 and the metal tube 52 are sometimes hard to be screwed together, in addition, it is time-consuming if a user has to screw or unscrew hundreds of connector in one day. Consequently, said conventional structure is required to be improved.

SUMMARY OF THE INVENTION

In view of the foregoing drawbacks of said conventional automobile driving warning equipment, an innovative "fast coupling structure of waterproof cable connector" is therefore disclosed hereafter.

The main objective of the present invention is to provide a fast coupling structure of waterproof cable connector, having a male connecting joint and a female connecting joint thereof coupled together with the waterproof and fast connection effects; therefore, a user is able to easily and quickly connect or disassemble the coupling structure of the invention.

To achieve said objectives, the fast coupling structure of waterproof cable connector of the invention mainly comprises a male connecting joint and a female connecting joint by molding for connection of electric power source or signals on an electric apparatus, both are fastened on the electric power source or signal transmission end of a cable wire; the characteristics are described as follow.

The male connecting joint comprises a male housing, a cover and a plurality of male connectors. The male housing is formed as the shape of a cylinder, having a plurality of terminal holes disposed inside thereof and a longitudinal groove disposed on the outer surface of the front thereof. The longitudinal groove has a leakage preventing ring and a convex ring disposed on the rear edge thereof; in addition, the convex ring has at least a groove and a raised portion disposed on the rear edge thereof. The raised portion has an aperture horizontally disposed corresponding to the position on one lateral side of the groove and an aperture vertically disposed corresponding to the position on the other lateral side of the groove away from the raised portion. A C-shaped rail is positioned between the two apertures and is sleeved by a press-resistant spring. The cover has two concave rings included in the inner surface thereof and an inner rim inwardly disposed on the rear thereof to sleeve the male housing on the rear, thereby enabling the inner rim to be wedged on the rear area of the convex ring and enabling the cover to revolve freely. The two concave rings respectively dispose an E-shaped retaining rings and each of the E-shaped retaining rings inwardly forms three elastic retaining points. In addition, the cover has two raised portions correspondingly and upwardly disposed on the inner surface thereof along the inner rim; wherein one of the two raised portions has the same height as the raised portion on the male housing and the other raised portion is at higher position with a slot set thereof. The male connector has the rear thereof connected an electric conductive copper-core of a cable wire and positioned in the terminal holes of the male housing. Eventually, the rear of the male housing and the end of the cable wire are integrated by a molding wiring gripper.

The female connecting joint comprises a female housing and a plurality of female connectors. The female housing is formed in the cylinder shape, having a coupling sleeve extended to form a space onward and inside thereof. Moreover, the female housing has a plurality of terminal holes set inside thereof. The internal diameter of the coupling sleeve is correspondent with the external diameter on the front of the male housing of the male connecting joint and a rib is vertically disposed on the inner surface thereof corresponding to the position of the longitudinal groove on the male housing. The outer surface of the coupling sleeve is shaped with an onward taper angle, having three retaining grooves disposed corresponding to the three retaining points on each E-shaped retaining ring. In addition, three channels are disposed between the retaining grooves respectively. The rear of the female connector and the electric conductive copper-core of the cable wire are connected together and positioned in the terminal holes of the female housing and protruded onward to the front of the coupling sleeve. Eventually, the rear of the female housing and the end of the cable wire are integrated by the molding wiring gripper.

To assemble the invention, a user inserts the longitudinal groove on the male housing of the male connecting joint into the rib in the female housing of the female connecting joint. Subsequently, the position of the male connector automatically corresponds to that of the female connector and both are coupled together. Meanwhile, the front of the male housing of the male connecting joint is inserted into the space formed in the coupling sleeve on the front of the female housing of the female connecting joint. Upon complete positioning, the opening on the front of the coupling sleeve of the female connecting joint is properly against the leakage preventing ring on the front of the inner rim of the male connecting joint. Moreover, the three retaining points on each E-shaped retaining ring in the cover of the male connecting joint are properly wedged in the three retaining grooves outside the coupling sleeve of the female connecting joint. The invention enables both of the male and the female connecting joints to have the fast coupling function and the waterproof effects. Therefore, a user is able to easily and quickly disassemble the coupling structure by revolving the cover to a certain angle to enable the three retaining points on the E-shaped retaining ring to be apart from the three retaining grooves outside the coupling sleeve and correspondent with the positions of the channels, so that a user is able to easily and quickly disassemble the coupling structure by pulling the cover out.

Accordingly, when the male connecting joint and the female connecting joint of the invention are integrated and coupled together, the elastic E-shaped retaining ring in the cover is locked in the retaining groove of the female connecting joint; in addition, when the cover is revolved to a certain angle and pulled out, the invention is easily detached from the connector. Consequently, the invention possesses the waterproof and fast connection or removal effects.

DESCRIPTION OF THE PREFERRED EMBODIMENT

Further aspects, objects, and desirable features of the invention will be better understood from the detailed description and drawings that follow in which various embodiments of the disclosed invention are illustrated by way of examples.

Figure 1:
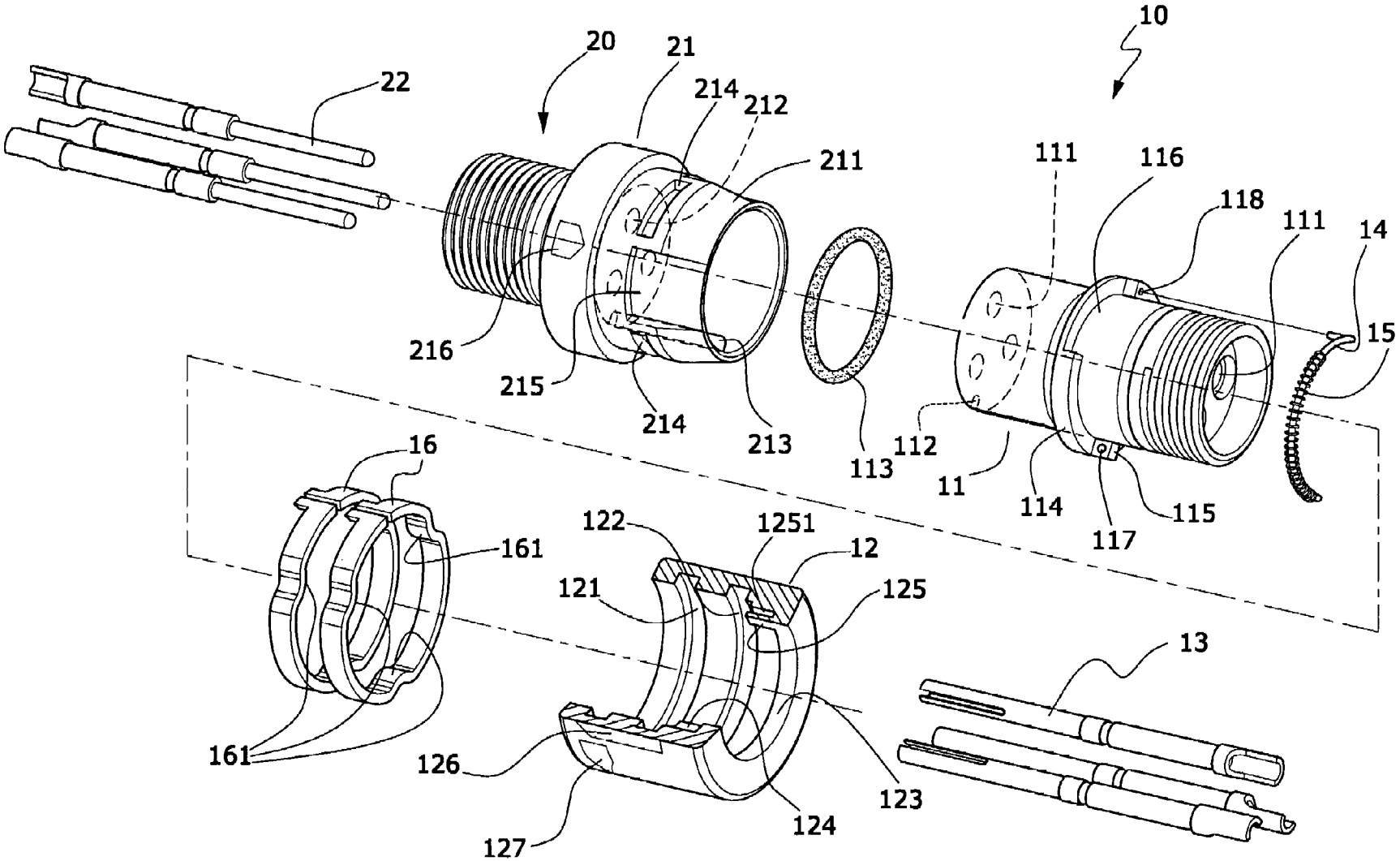
FIG. 1 is a three-dimensional exploded view in accordance with the invention.
Figure 2:
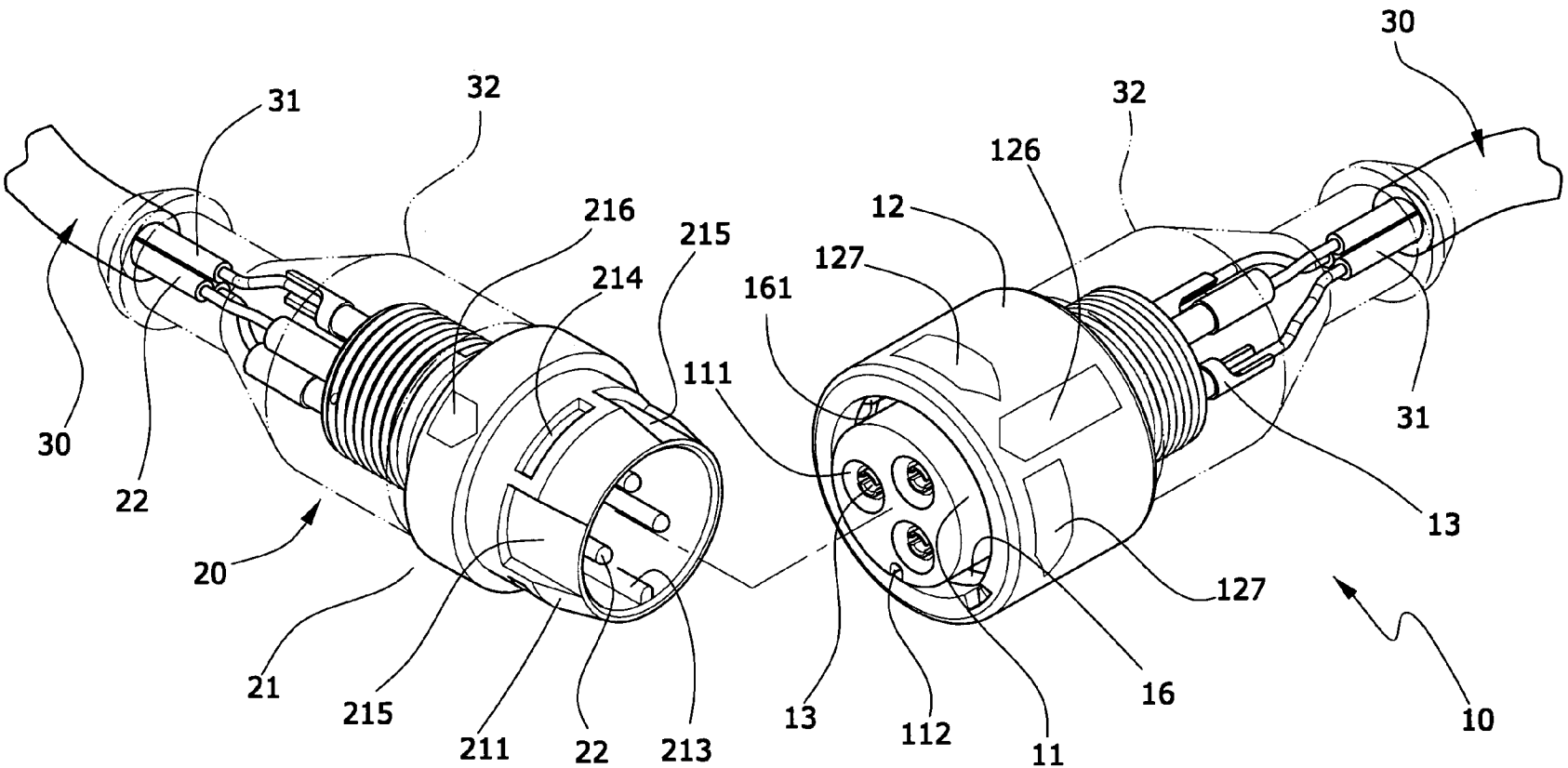
FIG. 2 is a perspective view showing the assembly of the invention.
Figure 3:
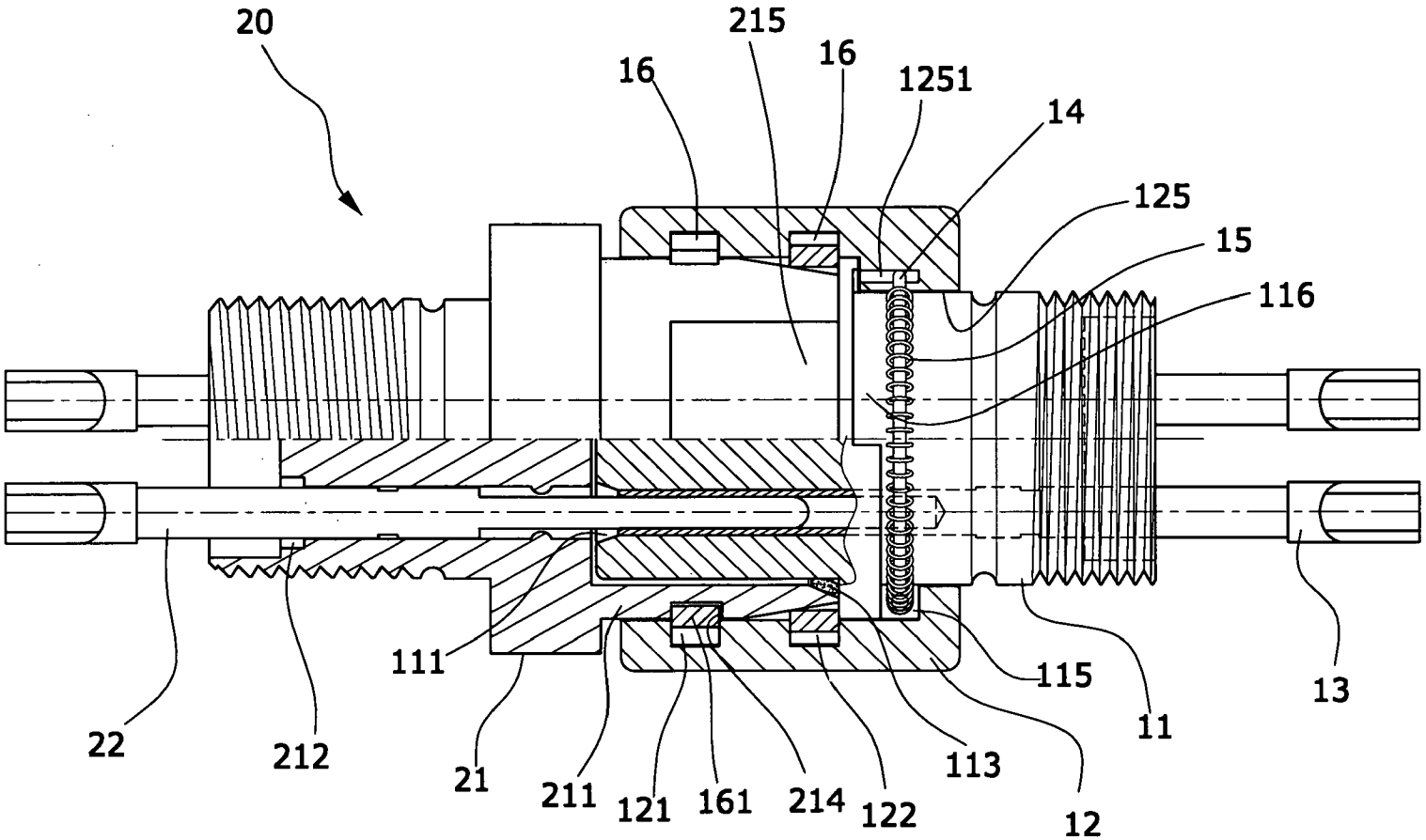
FIG. 3 is a cross-sectional view showing the assembly of a male connecting joint and a female connecting joint in accordance with the invention.
Figure 4:
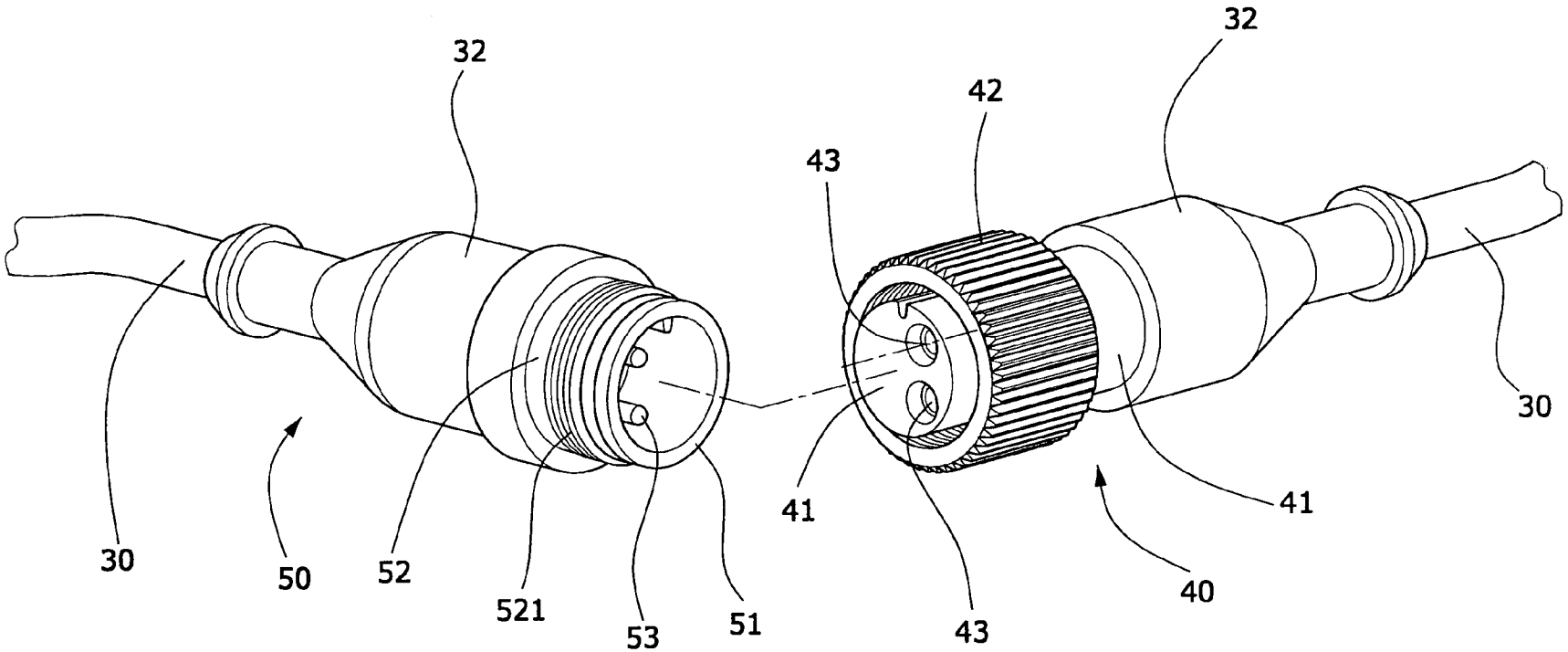
Fig.4 (Prior Art)
FIG. 4 is a perspective view showing the structure of a conventional structure.
Figure 5:
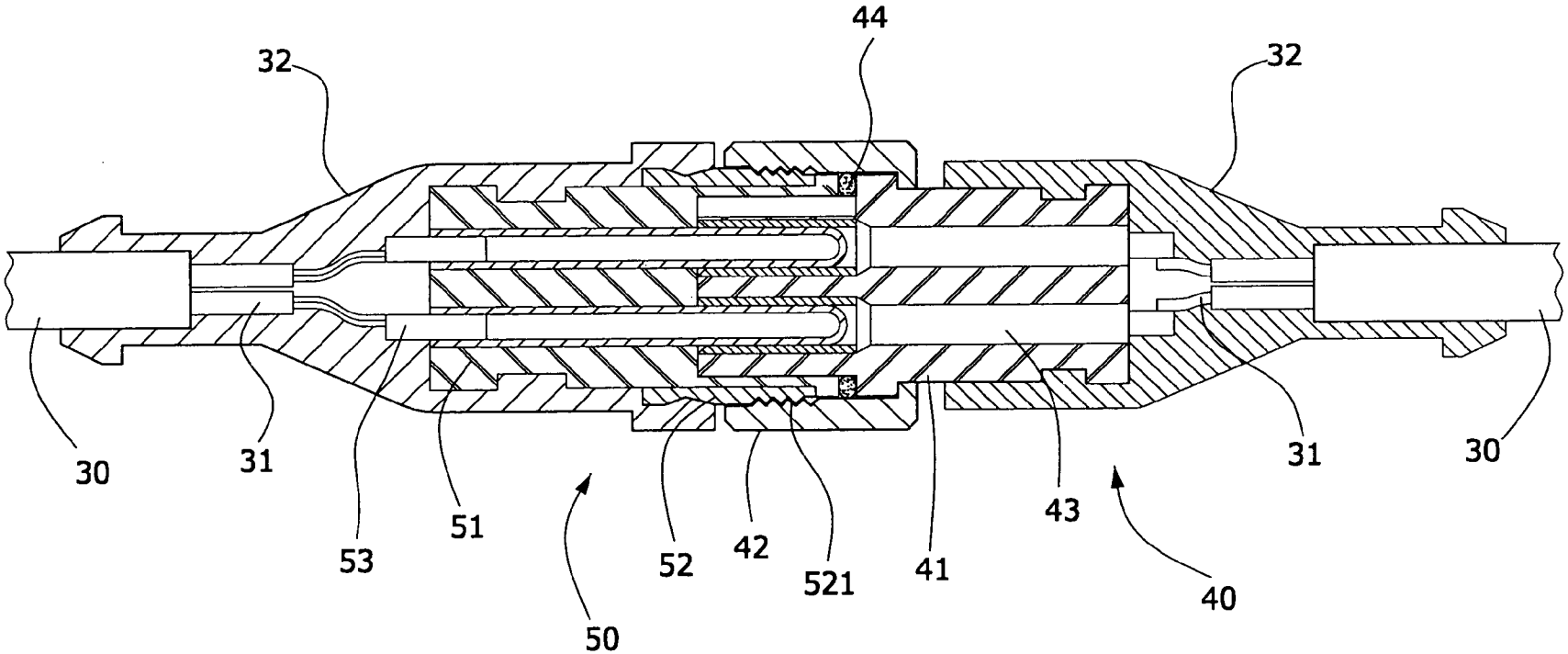
Fig.5 (Prior Art)
FIG. 5 is a cross-sectional view showing the assembly of a conventional structure.

As shown in FIGS. 1 to 3 that a fast coupling structure of waterproof cable connector of the invention mainly comprises a male connecting joint 10 and a female connecting joint 20 by molding; for connection of electric power source or signals on an electric apparatus, both are fastened on the electric power source or signal transmission end of a cable wire 30. The characteristics can be described as follow.

The male connecting joint 10 comprises a male housing 11, a cover 12 and a plurality of male connectors 13. The male housing 11 is formed in the shape of a cylinder, having a plurality of terminal holes 111 disposed inside thereof and a longitudinal groove 112 disposed on the outer surface of the front thereof. The longitudinal groove 112 has a leakage preventing ring 113 and a convex ring 114 disposed on the rear edge thereof; in addition, the convex ring 114 has at least a raised portion 115 and a groove 116 disposed on the rear edge thereof. The raised portion 115 has an aperture 117 horizontally disposed corresponding to the position on one lateral side of the groove 116 and an aperture 118 vertically disposed corresponding to the position on the other lateral side of the groove 116 away from the raised portion 115. A C-shaped rail 14 is positioned between the two apertures 117 and 118 and is sleeved by a press-resistant spring 15. The cover 12 has two concave rings 121 and 122 included in the inner surface thereof and an inner rim 123' inwardly disposed on the rear thereof to sleeve the male housing 11 on the rear, thereby enabling the inner rim 123 to be wedged on the rear area of the convex ring 114 and enabling the cover to revolve freely. The two concave rings 121 and 122 respectively dispose E-shaped retaining rings 16 and each of the E-shaped retaining rings 16 inwardly forms three elastic retaining points 161. In addition, the cover 12 has two raised portions 124 and 125 correspondingly and upwardly disposed on the inner surface thereof along the inner rim 123; wherein the raised portion 124 has the same height as the raised portion 115 on the male housing 11 to maintain the revolving stability upon coupling, the raised portion 125 is at higher position to be placed in the groove 116 of the male housing 11 so as to limit the revolving angle range (route). In addition, the raised portion 125 has a slot 1251 set thereof to enable the C-shaped rail 14 to pierce through and enable one side of the raised portion 125 and the front of the press-resistant spring 15 to be against each other; therefore the cover 12 is able to restore to the original position by elasticity after revolving to a certain angle. The male connector 13 has the rear thereof connected an electric conductive copper-core 31 of a cable wire 30 and positioned in the terminal holes 111 of the male housing 11. Eventually, the rear of the male housing 11 and the end of the cable wire 30 are integrated by the molding wiring gripper 32.

The female connecting joint 20 comprises a female housing 21 and a plurality of female connectors 22; the female housing 21 is formed in the cylinder shape, having a coupling sleeve 211 extended to form a space onward and inside thereof. Moreover, the female housing 21 has a plurality of terminal holes 212 set inside thereof. The internal diameter of the coupling sleeve 211 is correspondent with the external diameter on the front of the male housing 11 of the male connecting joint 10 and a rib 213 is vertically disposed on the inner surface thereof corresponding to the position of the longitudinal groove 112 on the male housing 11. The outer surface of the coupling sleeve 211 shaped with an onward taper angle, having three retaining grooves 214 disposed corresponding to the three retaining points 161 of each E-shaped retaining ring 16. In addition, three channels 215 are disposed between the retaining grooves 214, respectively. The rear of the female connector 22 and the electric conductive copper-core 31 of the cable wire 30 are connected together and positioned in the terminal holes 212 of the female housing 21 and protruded onward to the front of the coupling sleeve 211. Eventually, the rear of the female housing 21 and the end of the cable wire 30 are integrated by the molding wiring gripper 32.

To assemble the invention, a user inserts the longitudinal groove 112 on the male housing 11 of the male connecting joint 10 into the rib 213 in the female housing 21 of the female connecting joint 20. Subsequently, the position of the male connector 13 automatically corresponds to that of the female connector 22 and both are coupled together. Meanwhile, the front of the male housing 11 of the male connecting joint 10 is inserted into the space formed in the coupling sleeve 211 on the front of the female housing 21 of the female connecting joint 20. Upon complete positioning, the front of the coupling sleeve 211 of the female connecting joint 20 is properly against the leakage preventing ring 113 on the front of the convex ring 114 of the male connecting joint 10. Moreover, the three retaining point 161 on each E-shaped retaining ring 16 in the cover 12 of the male connecting joint 10 are properly wedged in the three retaining grooves 214 outside the coupling sleeve 211 of the female connecting joint 20. The invention enables both of the male and the female connecting joints to have the fast coupling function and the waterproof effects (as shown in FIG. 3); therefore, a user is able to easily and quickly connect or disassemble the coupling structure by revolving the cover 12 to a certain angle to enable the three retaining points 161 on the E-shaped retaining ring 16 to be apart from the three retaining groove 214 outside the coupling sleeve 211 and correspondent with the positions of the three vertical channels 215, so that a user is able to easily and quickly disassemble the coupling structure by pulling the cover out. In addition, the raised portion 125 of the cover 12 of the invention has the slot 1251 set thereof to enable the C-shaped rail 14 on the male housing 11 and the press-resistant spring 15 to be against each other; therefore, when a user follows the directional instruction to revolve the cover for disconnection, the cover 12 is able to restore to original position (the positions of respective retaining points 161 corresponding to respective retaining grooves 214) and is ready to be re-connected as required.

With reference to FIGS. 1 and 2, to enable a user to easily couple the male connecting joint 10 and the female connecting joint 20 together, the cover 11 of the male connecting joint 10 has a position indicator 126 and a direction indicator 127 labeled thereon and the convex ring outside the rear of the coupling sleeve 211 of the female connecting joint 20 has a position indicator 216 labeled thereon. When the two position indicators 126 and 216 are correspondent with each other, the groove 112 and the male connector 13 of the male connecting joint 10 are simultaneously corresponding to the rib 213 and the female connector 22 of the female connecting joint 20 for connection. Upon detachment of the connector, a user may follow the instruction of the direction indicator 127 and revolve the cover 12 on the indicated direction to the end; the three retaining points 161 of the E-shaped retaining ring 16 in the cover 12 is corresponding to the positions of the three channel 215 and the connector is easily to be detached.

Accordingly, the coupling of the male connecting joint 10 and the female connecting joint 20 of the invention are fastened together by locking the elastic E-shaped retaining ring 16 inside the cover 12 and the retaining groove 214 of the female connecting joint 20. Subsequently, the connector is easily coupled. Moreover, when the cover 12 is revolved to a certain angle and pulled out, the invention is then easily detached from said connector. Therefore, the invention has the waterproof and fast connection effects and enables a user to easily and quickly connect or disassemble the coupling structure.

In view of the forging, the "fast coupling structure of waterproof cable connector" of the invention is a cable connector structure for connection of electric power source or signals on an electric apparatus having the waterproof and fast coupling or disassembling advantages and effects. To sum up, the invention has the effects of practicability, innovation and advancement in the industry, and therefore, is disclosed herein.

New characteristics and advantages of the invention covered by this document have been set forth in the foregoing description. It is to be expressly understood; however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A fast coupling structure of waterproof cable connector, mainly comprising:

a male connecting joint and a female connecting joint by molding, for connection of electric power source or signals on an electric apparatus, both are fastened on the electric power source or signal transmission end of a cable wire; the characteristics are described as follow:

the male connecting joint comprises a male housing, a cover and a plurality of male connectors; the male housing is formed in the shape of a cylinder, having a plurality of terminal holes disposed inside thereof and a longitudinal groove disposed on the outer surface of the front thereof; the groove having a leakage preventing ring and a convex ring, disposed on the rear edge thereof; in addition, the convex ring has at least a groove and a raised portion disposed on the rear edge thereof; the raised portion having an aperture horizontally disposed corresponding to the position on one lateral side of the groove and an aperture vertically disposed corresponding to the position on the other lateral side of the groove away from the raised portion; a C-shaped rail is positioned between the two apertures sleeved by a press-resistant spring; the cover has two concave rings included in the inner surface thereof and an inner rim inwardly disposed on the rear thereof to sleeve the male housing on the rear, thereby enabling the inner rim to be wedged on the rear area of the convex ring and enabling the cover to revolve freely; the two concave rings respectively dispose an E-shaped retaining rings, each of the E-shaped retaining rings inwardly forms three elastic retaining points; in addition, the cover has two raised portions correspondently and upwardly disposed on the inner surface thereof along the inner rim; wherein one of the two raised portions has the same height as a raised portion on the male housing and the other raised portion is at higher position having a slot set thereof; the male connector has the rear thereof connected an electric conductive copper-core of a cable wire and positioned in the terminal holes of the male housing; eventually, the rear of the male housing and the end of the cable wire are integrated by a molding wiring gripper;

the female connecting joint comprises a female housing and a plurality of female connectors; the female housing is formed in the cylinder shape, having a coupling sleeve extended to form a space onward and inside thereof; the female housing has a plurality of terminal holes set inside thereof; the internal diameter of the coupling sleeve is correspondent with the external diameter on the front of the male housing of the male connecting joint and a rib is vertically disposed on the inner surface thereof corresponding to the position of the longitudinal groove on the male housing; the outer surface of the coupling sleeve is shaped with an onward taper angle, having three retaining grooves disposed corresponding to the three retaining points on each E-shaped retaining ring and three channels are disposed between the retaining grooves; the rear of the female connector and the electric conductive copper-core of the cable wire are connected together and positioned in the terminal holes of the female housing and protruded onward to the front of the coupling sleeve; eventually, the rear of the female housing and the end of the cable wire are integrated by the molding wiring gripper;

to assemble the invention, a user inserts the longitudinal groove on the male housing of the male connecting joint into the rib in the female housing of the female connecting joint and subsequently, the position of the male connector automatically corresponds to that of the female connector and both are coupled together; meanwhile, the front of the male housing of the male connecting joint is inserted into the space formed in the coupling sleeve on the front of the female housing of the female connecting joint; upon complete positioning, the three retaining points on an E-shaped retaining ring inside the cover of the male connecting joint are wedged in the three retaining grooves outside the coupling sleeve of the female connecting joint; thereby the male connecting joint and the female connecting joint are quickly coupled together; upon detachment of the wedged in the three retaining grooves outside the coupling sleeve of the female connecting joint, the cover is revolved to a certain angle to enable the three retaining points on the E-shaped retaining ring to be apart from the three retaining grooves outside the coupling sleeve and correspondent with the positions of the channels; the structure is then easily and quickly pulled out and detached.

2. The fast coupling structure of waterproof cable connector of claim 1, wherein the structure has a position indicator and a direction indicator, both are labeled on the male connecting joint cover; a position indicator is placed outside the convex ring on the rear of the coupling sleeve of the female connecting joint.

* * * * *